US006920763B2

(12) United States Patent
Amundsen et al.

(10) Patent No.: US 6,920,763 B2
(45) Date of Patent: Jul. 26, 2005

(54) INTEGRATION OF AUTOMATED CRYOPUMP SAFETY PURGE

(75) Inventors: Paul E. Amundsen, Ipswich, MA (US); Maureen Buonpane, Mansfield, MA (US); Doug Andrews, Millis, MA (US); Jordan Jacobs, Randolph, MA (US)

(73) Assignee: Helix Technology Corporation, Mansfield, MA (US)

( * ) Notice: Subject to any disclaimer, the term of this patent is extended or adjusted under 35 U.S.C. 154(b) by 14 days.

(21) Appl. No.: 10/608,851

(22) Filed: Jun. 27, 2003

(65) Prior Publication Data

US 2004/0261426 A1 Dec. 30, 2004

(51) Int. Cl.[7] ..... B01D 8/00
(52) U.S. Cl. ..... 62/55.5
(58) Field of Search ..... 62/55.5

(56) References Cited

U.S. PATENT DOCUMENTS

| | | | | |
|---|---|---|---|---|
| 3,254,871 A | | 6/1966 | Limon | |
| 4,156,432 A | | 5/1979 | Helwig, Jr. | |
| 4,718,240 A | | 1/1988 | Andeen et al. | |
| 4,735,084 A | | 4/1988 | Fruzzetti | |
| 4,757,689 A | | 7/1988 | Bächler et al. | |
| 4,958,499 A | * | 9/1990 | Haefner et al. | 62/55.5 |
| 5,062,271 A | * | 11/1991 | Okumura et al. | 62/55.5 |
| 5,123,277 A | * | 6/1992 | Gray et al. | 73/29.01 |
| 5,305,612 A | | 4/1994 | Higham et al. | |
| 5,400,604 A | * | 3/1995 | Hafner et al. | 62/55.5 |
| 5,443,368 A | * | 8/1995 | Weeks et al. | 417/27 |
| 5,450,316 A | * | 9/1995 | Gaudet et al. | 700/79 |
| 5,513,499 A | | 5/1996 | deRijke | |
| 5,517,823 A | * | 5/1996 | Andeen et al. | 62/55.5 |
| 5,684,463 A | | 11/1997 | Diercks et al. | |
| 5,893,234 A | | 4/1999 | McKeon | |
| 5,906,102 A | | 5/1999 | Bartlett et al. | |

(Continued)

FOREIGN PATENT DOCUMENTS

EP 0 684 382 B1 4/1995

OTHER PUBLICATIONS

Liebert, R.B., et al., "Safety considerations in cryopumping systems for ion implanters", Ion Implantation Technology, 94: 548–552 (1995).

(Continued)

*Primary Examiner*—William C. Doerrler
(74) *Attorney, Agent, or Firm*—Hamilton, Brook, Smith & Reynolds, P.C.

(57) ABSTRACT

An electronic controller is integral with a cryopump and provides an offline solution for purging a cryopump and an exhaust line during unsafe conditions. The electronic controller is responsible for controlling the opening and closing of purge, exhaust purge and gate valves coupled to the cryopump. The electronic controller can preempt any attempts from other systems to control these valves during unsafe conditions. An unsafe condition can be a power failure in the cryopump, a dangerous temperature in the cryopump or a temperature sensing diode that is not operating properly. When an unsafe condition is determined, the exhaust purge valve is opened and the gate valve closed, while the opening of a purge valve may be delayed for a safe period of time. If the unsafe condition still exists when the safe period of time elapses, the purge valve is allowed to open.

A fail-safe purge valve release and time delay mechanism can be used to ensure that the purge valve opens after the period of time elapses. Electrochemical capacitors store an amount of energy to hold a normally open purge valve closed for a safe period of time. When this energy is discharged and the unsafe condition still exists, the purge valve automatically opens.

83 Claims, 7 Drawing Sheets

U.S. PATENT DOCUMENTS

| | | | | |
|---|---|---|---|---|
| 6,216,467 | B1 | | 4/2001 | O'Neil et al. |
| 6,233,948 | B1 | * | 5/2001 | Morishita et al. ..... 62/55.5 |
| 6,272,400 | B1 | | 8/2001 | Jankins et al. |
| 6,318,093 | B2 | * | 11/2001 | Gaudet et al. ..... 62/55.5 |
| 6,327,863 | B1 | * | 12/2001 | Yamartino et al. ..... 62/55.5 |
| 6,427,969 | B1 | | 8/2002 | Ho et al. |
| 6,510,697 | B2 | * | 1/2003 | Buonpane et al. ..... 62/55.5 |

OTHER PUBLICATIONS

Mundinger, H.J., et al., "A new cryopump with a very fast regeneration system", *Vacuum*, 43(5–7):545–549 (1992).

Rao, M.G., et al., "Use of Indigenous Molecular Sieves in Cryosorption Pumping Applications," *VAC News*, 12(3): 15–18.

Drzal, L. T., et al., "A high precision volumetric gas adsorption apparatus for surface studies," *Rev. Sci. Instrum.*, 45(11) 1331–1335 (1974).

deRijke, J.E., "Performance of a cryopump–ion pump system," *J. Vac. Sci. Technol.* 15(2) 765–767 (1978).

Longsworth, R.C., et al. "Cryopump regeneration studies," *J. Vac. Sci. Technol.* 21(4) 1022–1027 (1982).

* cited by examiner

| FIG. 4A | FIG. 4B |
|---|---|

INTEGRATION OF AUTOMATED CRYOPUMP SAFETY PURGE

BACKGROUND

The hazardous and reactive nature of the gaseous emissions during ion implantation generates safety and handling challenges. Each tool discharges different types and concentrations of volatile and hazardous gases in a continuous or intermittent mode. Hydrogen, for instance, can be a byproduct of implantation. While hydrogen alone is not hazardous, there is a potential risk of ignition. Several factors can cause ignitions to occur. Such factors include the presence of an oxidizer, a specific combination of pressure and temperature, certain ratios of hydrogen and oxygen, or an ignition source.

Cryogenic vacuum pumps (cryopumps) are a type of capture pump that are often employed to evacuate gases from process chambers because they permit higher hydrogen pumping speeds. Due to the volatility of hydrogen, great care must be taken to assure that safe conditions are maintained during normal use and during maintenance of cryopumps in implanter applications. For example, cryopumped gases are retained within the pump as long as the pumping arrays are maintained at cryogenic temperatures. When the cryopump is warmed, these gases are released. It is possible that the mixtures of gases in the pump may ignite during this process. When the hydrogen vents from the pump, it can also cause a potentially explosive mixture with oxygen in the exhaust line/manifold system which is coupled to the cryopump.

A common scheme for managing safety functions in a cryopump involves a distributed system. In a typical configuration, a cryopump is networked and managed from a network terminal, which provides a standardized communication link to the host control system. Control of the cryopump's local electronics is fully integrated with the host control system. In this way, the host control system controls the safety functions of the cryopump and can regenerate and purge the cryopump in response to a dangerous situation. This feature puts the pump into a safe mode to reduce the risks of combustion. Purging the pump can dilute hydrogen gas present in the pump as the hydrogen is liberated from the pump and vented into an exhaust system.

SUMMARY OF THE INVENTION

The scheme described above works well until there is a communication or equipment failure. Such failures can prevent the host control system from managing the safety features incorporated in the cryopump effectively. During a power outage, for example, there could be a problem with the communication link between the cryopump and the host controller. Failure to open the purge valve during a power outage may subject any hydrogen gas present in the pump to the possibility of ignition. In general, these systems do not provide a comprehensive safety solution to the potentially hazardous situations that may arise in the pump.

Further, some cryopumps have a normally open purge valve, which may automatically open after a loss of power. Usually, the purge valve may be closed from a terminal by a user command, which changes the operating mode of the cryopump. The purge valves may also be closed by using reset or override switches. Consequently, such purge valves may be closed by a user or by the host controller during potentially dangerous or unsafe conditions, for example, when hydrogen gas is present within the cryopump, and an ignition can result due to its volatility.

The present invention includes comprehensive fail-safe features for the prevention of safety hazards arising from an unsafe condition in a cryopump. An unsafe condition can be a power failure in the cryopump, faulty temperature sensing diode in the cryopump, or temperature of the cryopump exceeding a threshold temperature level. The invention can control the purge valve during unsafe conditions and can override any attempts from other systems, such as the host controller, from controlling the operation of the cryopump.

The invention may include a system and method for controlling a cryopump. An unsafe condition in the cryopump can be determined and purge gas can be directed into the cryopump. The cryopump can be purged by directing one or more purge valves (cryo-purge valve or exhaust purge valve) to open. The cryopump, for instance, can be purged by causing the cryo-purge valve to open. The exhaust system can be purged by causing the exhaust purge valve to open. The purge valve and exhaust purge valve can be normally open valves, and they can be maintained open upon release. The purge valve and the exhaust purge valve can be cyclically opened and closed. By purging the cryopump, any hydrogen present in the pump and exhaust line may be diluted and the chance of combustion can be reduced.

An electronic controller coupled to the cryopump may be used to respond to an unsafe condition by initiating a safe purge in which one or more purge valves are directed to open. The controller can override any other system while it in safe purge. The purge valves can be automatically controlled by the controller and maintained open by activating an interlock, which prevents any user or host controller from closing the purge valve.

By releasing the purge valves during a safe purge, purge gas can be delivered into the cryopump and into the exhaust line. Purge gas can be directed from the cryo-purge valve to the second stage array of the cryopump. The invention can ensure that the valves stay open for a sufficient period of time by overriding any instructions from other systems, and by preventing the safe purge from being aborted. Local electronics may be coupled to the pump to ensure that the purge valves can be controlled even if the cryopump is offline. A safe purge can be completed without initiating an entire regeneration process. After the safe purge is completed, the user or host system can determine whether an entire regeneration routine is necessary. Regeneration, however, can be prevented from occurring while a gate valve of the cryopump is open.

Another aspect of the invention includes a system and method for monitoring temperature sensors, such as temperature sensing diodes coupled to a cryopump. If one or more of the temperature sensing diodes is not functioning properly, a purge valve can be opened to apply purge gas into the cryopump.

The invention may include a power failure recovery system and method. When the power in a cryopump fails, the system may respond by directing the purge valves to open. In particular, after every power failure, the system may respond to restored power by determining whether the cryopump has warmed above a recovery temperature set point. The recovery temperature set point may be 34K. If the cryopump has warmed above the recovery temperature set point, a safe purge can be initiated. The invention can ensure that the safe purge cannot be aborted. In certain embodiments of the invention, the power failure recovery routine cannot be turned off.

The operating state of the cryopump at the moment of power loss can be determined. If the operating state indicates that the cryopump was in a regeneration process when the power failed, regeneration can be initiated.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

A description of preferred embodiments of the invention follows.

Cryogenic Vacuum System

Figure 1:
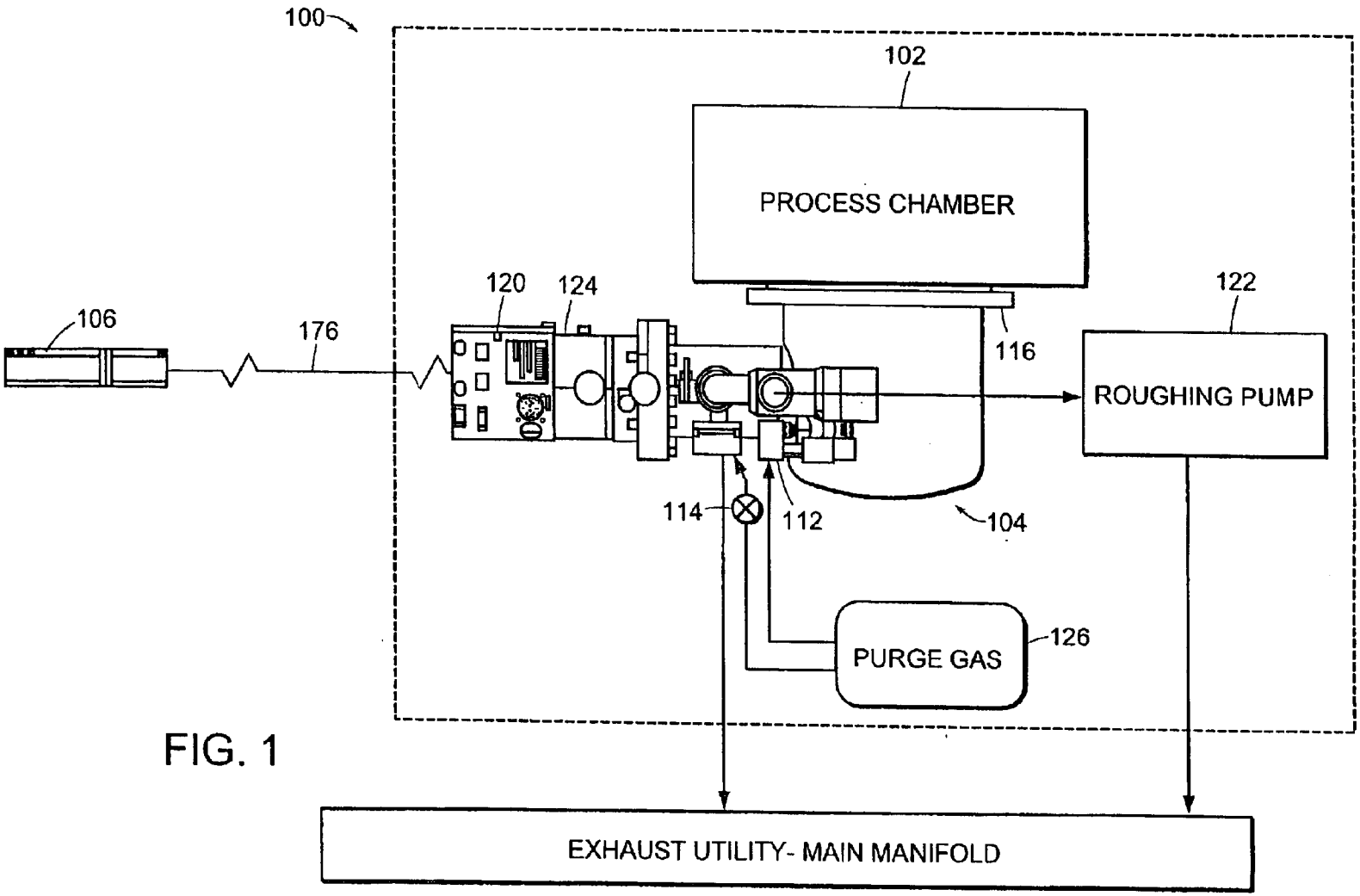
FIG. 1 is a diagram of a cryogenic vacuum system according to an embodiment of the present invention.

FIG. 1 is a diagram of a cryogenic vacuum system 100 according to an embodiment of the present invention. The cryogenic vacuum system 100 is coupled to a ion implant process chamber 102 for evacuating gases from the ion implant process chamber 102. The cryogenic vacuum system 100 includes at least one cryogenic vacuum pump (cryopump) 104 and usually at least one compressor (not shown) for supplying compressed gas to the cryopump 104. The cryogenic vacuum system 100 may also include roughing pumps 122, water pumps, turbopumps, chillers, valves 112, 114, 116 and gauges. Together, these components operate to provide cryogenic cooling to a broader system, such as a tool for semiconductor processing.

The tool may include a tool host control system 106 providing a certain level of control over the systems within the tool, such as the cryogenic vacuum system 100. The tool can use the processing chamber 102 for performing various semiconductor-fabrication processes such as ion implantation, wafer etching, chemical or plasma vapor deposition, oxidation, sintering, and annealing. These processes often are performed in separate chambers, each of which may include a cryopump 104 of a cryogenic vacuum system 100.

Figure 2:
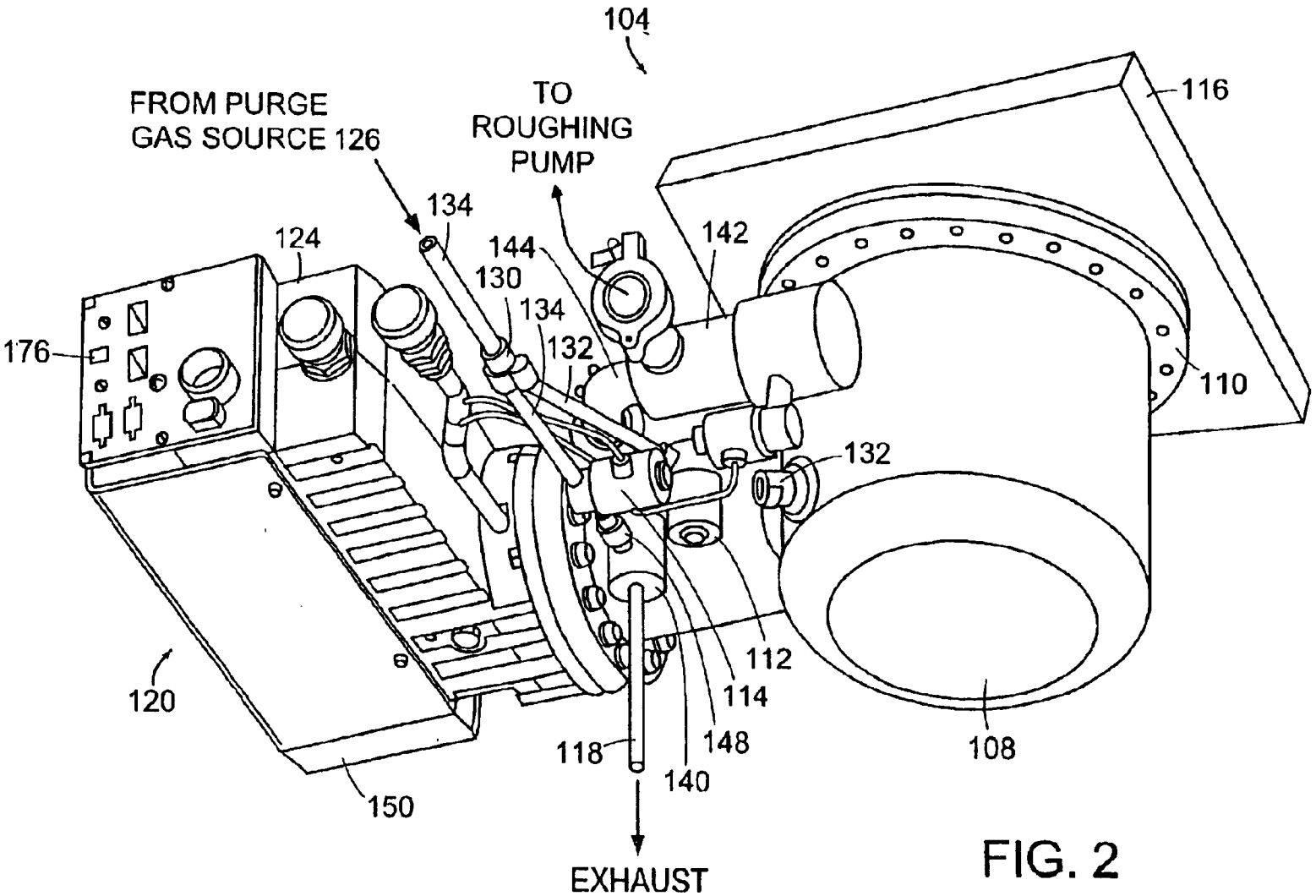
FIG. 2 is a diagram of a cryopump according to FIG. 1.

FIG. 2 is a diagram of a cryopump according to FIG. 1. The cryopump 104 includes a cryopump chamber 108 which may be mounted to the wall of the process chamber 102 along a flange 110. The cryopump chamber 108 may be similar to that described in U.S. Pat. No. 4,555,907. The cryopump 104 can remove gases from the process chamber 102 by producing a high vacuum and freezing the gas molecules on low-temperature cryopanels inside the cryopump 104.

Figure 3:
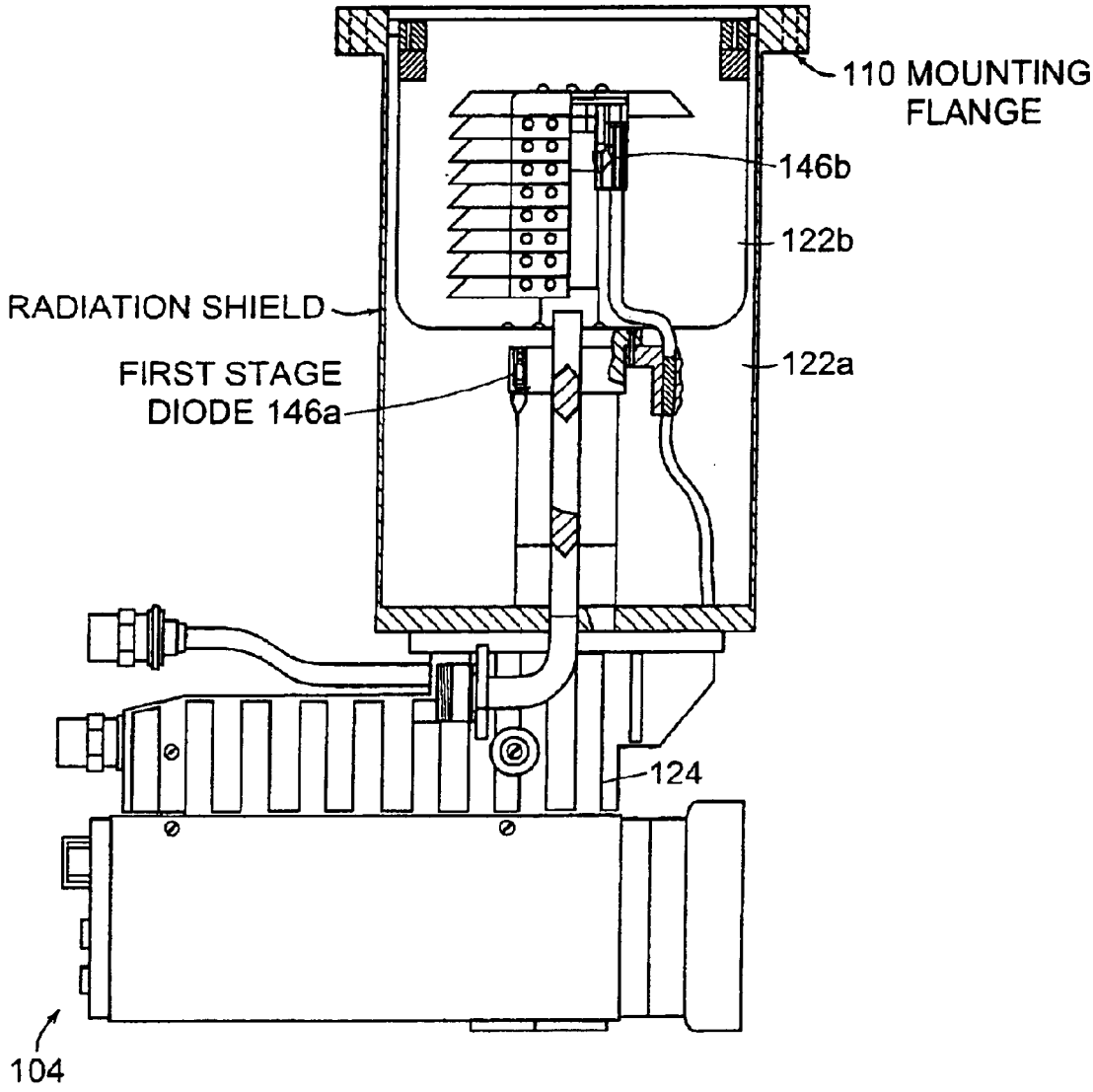
FIG. 3 is a cross-sectional view of a cryopump.

The cryopump 104 may include one or more stages. For example, a two stage pump includes a first stage array and second stage array that are cooled by a cryogenic refrigerator. As shown in FIG. 3, a first stage 122*a* may have cryopanels which extend from a radiation shield 138 for condensing high boiling point gases thereon such as water vapor. A second stage 122*b* may have cryopanels for condensing low boiling point gases thereon. The cryopanels of the second stage array may include an adsorbent, such as charcoal, for adsorbing very low boiling point gases such as hydrogen. Temperature sensing diodes 146*a,* 146*b* are used to determine the temperature of the first and second stages 122*a,* 122*b* of the cryopump 106. A two-stage displacer in the cryopump 104 is driven by a motor 124 contained within the housing of the cryopump 104.

After several days or weeks of use, the gases which have condensed onto the cryopanels, and in particular the gases which are adsorbed, begin to saturate the cryopump. The resulting mixture of gases is not necessarily hazardous as long as they remain frozen on the cryopanels. Warming of the arrays which results from a power loss, venting the cryopump 104 or vacuum accidents, however, may present a potentially unsafe condition in the cryopump 104 or in an exhaust line 118 coupled to the cryopump 104. During warm-up, any hydrogen in the cryopump 104 is quickly liberated and exhausted into the exhaust line 118 and the potential for rapid combustion of the hydrogen exists if a certain mixture of gases and an ignition source are present. To dilute the gases in the cryopump 104 and in the exhaust line 118, the cryopump 104 is purged with purge gas, as shown in FIG. 2.

During regeneration, the cryopump 104 is purged with purge gas. The purge gas hastens warming of the cryopanels and also serves to flush water and other vapors from the cryopump. It can be used to dilute any hydrogen liberated in the cryopump 104. Nitrogen is the usual purge gas because it is relatively inert and is available free of water vapor. By directing the nitrogen into the cryopump 104 close to the second-stage array 122*b,* the nitrogen gas which flows into the cryopump 104 minimizes the movement of water vapor from the first array 122*a* back to the second-stage array 122*b*. After the cryopump is purged, it may be rough pumped by a roughing pump 122 to produce a vacuum around the cryopumping surfaces and cold finger. This process reduces heat transfer by gas conduction and enables the cryopump to cool to normal operating temperatures. Purge gas is applied to the cryopump chamber 108 through a purge valve 112 coupled to the cryopump 104. Purge gas is also applied into the exhaust line 118 through an exhaust purge valve 114.

A purge gas source 126 is coupled to the cryopump chamber 108 via a conduit 128, connector 130, conduit 132, purge valve 112 and conduit 136. When the purge valve 112 is opened, the cryopump is purged with purge gas from the purge gas source 126. The purge valve 112 may be a solenoid valve, which is electrically operated and has two states, fully open and fully closed. The valve 112 may use a coil of wire, which, when energized by an electrical current, opens or closes the valve. If the current ceases, the valve 112 automatically reverts to its non-energized state. The valve 112 may be either a normally open or normally closed solenoid. In certain examples of the invention, as discussed in more detail below, it is preferable that it be a normally open valve. When energized, the valve 112 would be closed, but after an alarm condition is detected, the current to it would be switched off by a controller 120 coupled to the cryopump 104, and the normally open valve would open to supply the purge gas to the cryopump 104. The valve 112, for instance, remains closed for a period of time in response to a power failure, and opens after the period of time elapses.

The purge valve 112 may also include hardware and/or software interlocks. Hardware interlocks are typically electrical or mechanical devices that are fail-safe in their operation. Software interlocks are often used to interrupt a process before activating a hardware interlock.

The purge gas supply 126 is also coupled to the exhaust line 118, which is coupled to the cryopump 104. The exhaust line 118 is coupled to the purge gas supply 126 via a conduit 134 and an exhaust purge valve 114. The exhaust line 114 may include an exhaust valve 140 within a housing, which is coupled to the cryopump 104 via a conduit 142 and conduit 144. The exhaust valve 140 is coupled to the purge gas source 126 via conduit 128, connector 130, conduit 134, exhaust purge valve 114 and delivery conduit 148, as described in U.S. Pat. No. 5,906,102. In general, the exhaust valve 140 vents or exhausts gases released from cryopump chamber 108 into the exhaust line 118. From the exhaust line 118, the gases are driven into an exhaust utility main manifold where they may be treated via an abatement system, which may include wet or dry scrubbers, dry pumps and filters that can be used to process and remove the exhaust gases.

The exhaust purge valve 114 may be a solenoid valve that opens to deliver purge gas from purge gas source 126 to the exhaust line 118. During an unsafe condition, the exhaust purge valve 114 may deliver the purge gas into the exhaust line 118. If the exhaust purge valve 114 is a solenoid valve, it is similar to the one described above, in reference to the cryo-purge valve 112. The exhaust purge valve 114 may also include an interlock. Unlike the cryo-purge valve 112, however, preferably, there are no activation delays that affect the opening of the exhaust purge valve 114 in response to an unsafe condition.

Cryopump Control System

Figures 4, 4A:
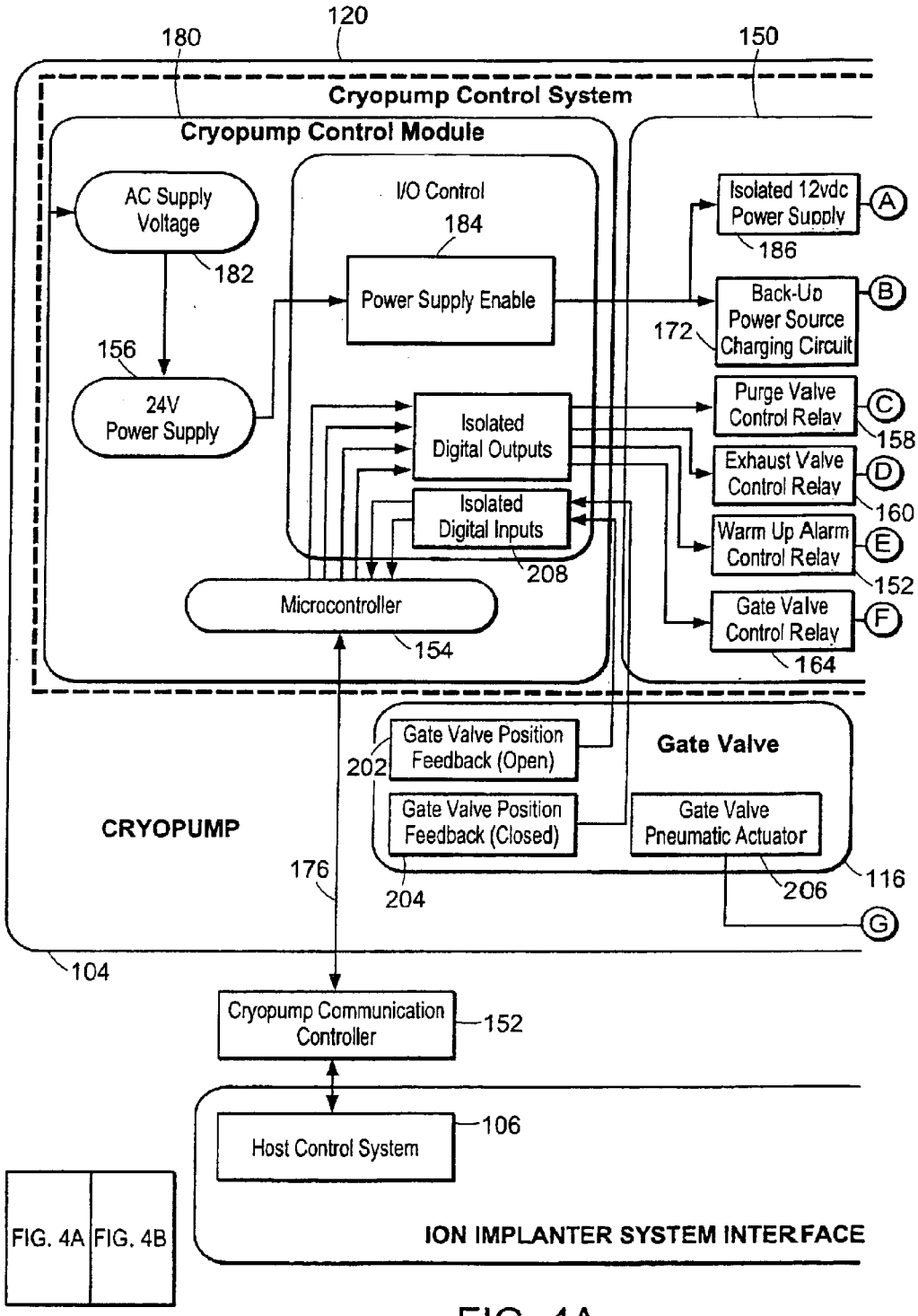
FIG. 4 is a block diagram of a cryopump control system.
Figure 4B:
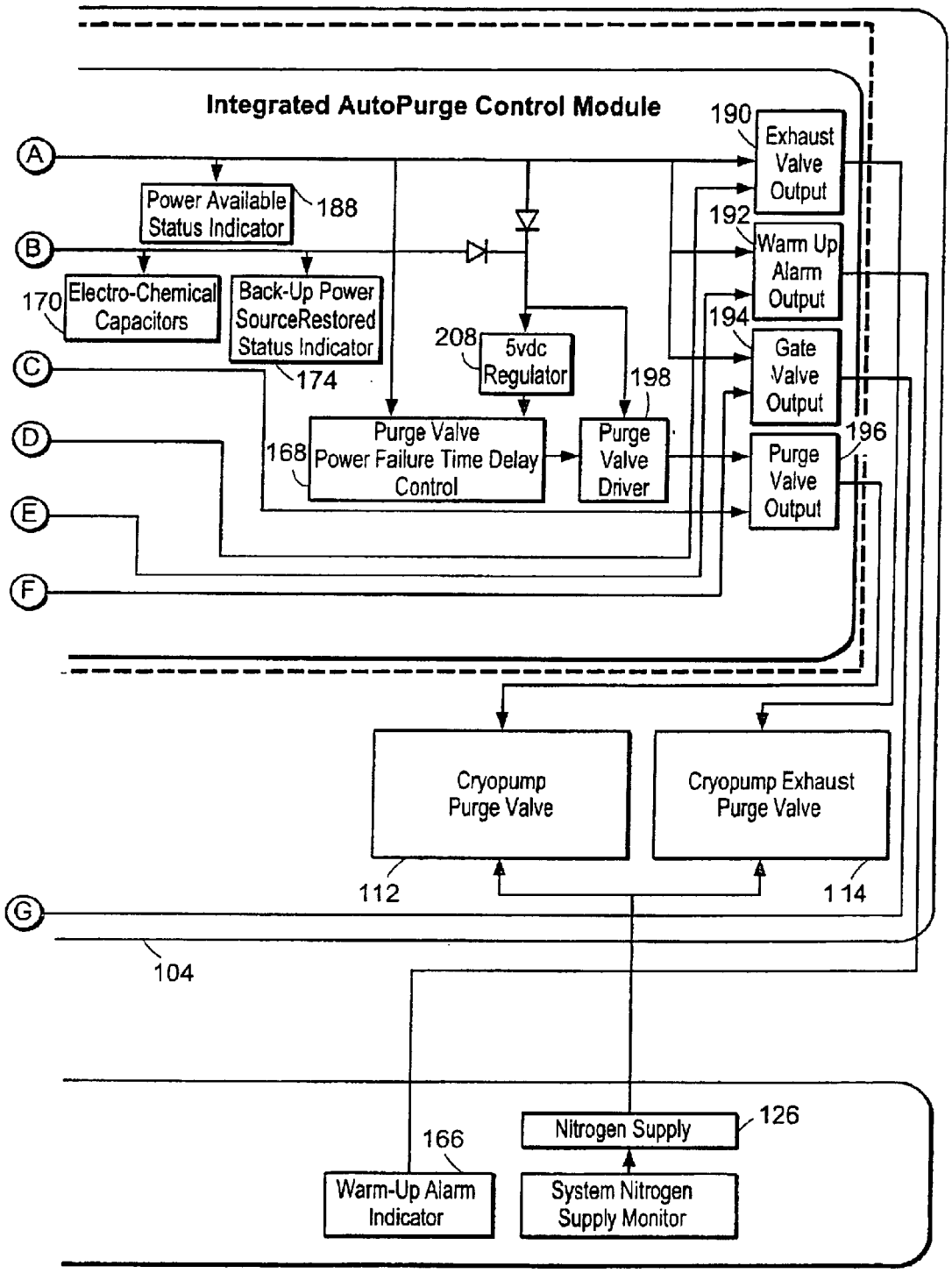

A cryopump control system 120 is shown in FIG. 4. The control system 120 is networked to the host controller 106. A network controller 152 may provide a communication interface to the host control system 106. In this way, the host control system 106 controls the cryopump 104 during normal operation. During unsafe situations, however, the control system 120 limits the control of any other systems by overriding any instructions from those systems. In addition, the control system 120 can inhibit any user from manually controlling the purge valves 112, 114 and gate valve 116.

The control system 120 includes a processor 154, which drives the operations of the cryopump 104. The processor 154 stores system parameters such as temperature, pressure, regeneration times, valve positions, and operating state of the cryopump 104. The processor 154 determines whether there are any unsafe or safe conditions in the cryopump 104. Preferably, the control system 120 is integral with the cryopump as described in U.S. Pat. No. 4,918,930, which is incorporated herein by reference in its entirety.

The architecture of the controller 120 may be based on a component framework, which includes one or more modules. In the particular implementation shown in FIG. 4, two modules are illustrated, a cryopump control module 180 and an autopurge control module 150. Although the controller 120 may be implemented as only one module, it may be desirable to separate the control system into components, 180, 150 which can be integrated with several different applications. By using a component model to design the control system 120, each module 180, 150 is thus not tied to a specific product, but may be applicable to multiple products. This allows each component to be individually integrated with any subsequent models or any controllers of other types of systems.

The control system 120 is responsible for monitoring and controlling the purge valves 112, 114 and gate valve 116 when an unsafe condition is detected. For example, when the control system 120 determines an unsafe condition in the cryopump, the control system 120 may ensure that the purge valves 112, 114 and gate valve 116 are either open or closed. The control system 120 uses the autopurge control module 150 to perform this task. The gate valve control is similar to that described in U.S. Pat. No. 6,327,863, which is incorporated herein by reference in its entirety.

The control module 180 includes an AC power supply input 182 which is coupled to a voltage regulator 156. The voltage regulator 156 outputs 24 volts AC to power the cryopump 104 including the integrated autopurge control module 150, valves 112, 114, 116 and ancillary system components. The voltage regulator 156 is coupled to a power supply enable controller 184 that supplies the power to the integrated autopurge control module 150.

The autopurge control module 150 includes an isolated voltage regulator 186 which is coupled to the 24 volt power supply 184. The voltage regulator 186 converts the 24 volts from the power supply 184 to 12 volts DC, which can be supplied to power the valves 112, 114, 116 via control output nodes 190, 194, 196.

The purge valves 112, 114 are normally open valves, and during normal operation of the cryopump, relays 158, 168 are energized to ensure that the purge valves 112, 114 remain closed. A purge valve driver (power amplifier) 198 is normally enabled to maintain the purge valve 112 closed during normal operation of the cryopump 104.

The gate valve 116 is a normally closed valve. The autopurge control module 150 ensures that the gate valve 116 is closed to isolate the cryopump 104 from the process chamber 102. Relay 164 is energized to control the state of the gate valve 116. Position sensors may be located within gate valve 116 which can detect whether the position of gate valve 116 is in an open or closed position. The position of the gate valve 116 is regulated by an actuator 206 (e.g. a pneumatic actuator, or solenoid). Gate valve 116 position feedback 202, 204 is input at an input node 208 to the processor 154.

A warm-up alarm indicator 166 is included in the autopurge control module 150. The warmup alarm indicator may be a status light-emitting diode that indicates whether the cryopump has warmed above a threshold temperature. The warmup alarm relay 162 controls the alarm indicator 166 via control output 192.

Current from the voltage regulator 186 flows through a power available status indicator 188, which is a status light-emitting diode that indicates whether power is being supplied from the voltage regulator 186. During a power failure, the status indicator 188 usually indicates that power is not being supplied from the voltage controller 186. According to one aspect of the invention, during a power failure, a back-up power supply using electrochemical capacitors 170 supplies power to the autopurge control module 150. A charging circuit 172 is used to charge electrochemical capacitors 170 when power is available. The charging circuit 172 charges the capacitors 170 by applying a series of current pulses to the capacitors 170.

Cryo-Purge Delay

During the power failure, the normally open exhaust purge valve 114 opens to purge the pump, while the cryo-purge valve 112 is held closed for a safe period of time. It is desirable to delay the opening of the cryo-purge valve 112 because initiating a safe purge of the cryopump 104 without a delay can lead to unnecessary waste of valuable time and resources. Purging the cryopump 104 destroys the vacuum in the cryopump and causes a release of gases which may then require regeneration and this is avoided if possible. Delaying opening of the purge valve for a period of time allows for possible retention of power and possible recovery by the controller 120 without interrupting operation of the cryopump with a purge.

Capacitors 170 are used to power the purge valve 112 closed by energizing the relay 158 and purge valve driver 198 for a safe period of time. A time delay control circuit 168 is used to determine when the safe period of time has elapsed after a power failure. In this example, the time delay circuit 168 operates on 5 volts and therefore, it is coupled to a 5 volt DC voltage regulator 200 that receives power from the isolated 12 DC voltage regulator 186. The voltage regulator 200 may be a zener diode.

The autopurge control module 150 delays the purging of the cryopump 104 for a safe period of time, and if power is not recovered after the period of time has elapsed, the purge valve 112 is allowed to open. If, however, the unsafe condition changes to a safe condition in a time less than the safe period of time, the control module 120 initiates a power failure recovery routine and reverts back to normal operation as if nothing happened. For example, a safe condition is determined when power is restored to the system or if it is determined that another system, such as the host controller 106, responded appropriately to the unsafe condition. By using a purge valve 112 delay and by aborting the response to the unsafe condition when the unsafe condition is corrected, the autopurge control module 150 can discourage the unnecessary waste of purge and recovery time and resources. If the safe period of time expires and the unsafe condition still exists, a safe purge is initiated, the purge valve 112 is allowed to open, and purge gas immediately vents the pump 104. According to an aspect of the invention, even if power is restored during the safe purge, the purging will continue for a purge time, such as five minutes, overriding any contrary input from a user or host control processor.

Prior systems have responded to the power failure by initiating a regeneration process. When power was restored, however, purging may have been halted. As a result, hazardous gases may have been liberated, possibly placing the pump in a combustible state. As discussed above, the present system continues a safe purge even if power is restored and, therefore, reduces the chances of combustion.

Fail-Safe Valve Release and Time Control Mechanisms

According to an aspect of the invention, fail-safe valve release and time control mechanisms are incorporated. The control system 120 incorporates a backup time control mechanism as a safeguard, which ensures that the purge valve 112 is open when the predetermined amount of time has elapsed. If for example, the timing circuit 168 does not allow the purge valve 112 to open after the predetermined amount of time elapses, backup power sources, such as the electro-chemical capacitors 170 are used to provide a fail-safe purge valve release mechanism.

The energy stored in the electro-chemical capacitors 170 depletes on power failure at a predicable rate (RC time constant). A limited amount of energy is stored in the capacitors 170 to hold the purge valve 112 closed for a safe period of time. If the valve 112, for instance, is a normally open valve, then the energy stored in the capacitors 170 can enable the purge valve electrical driver 198 and energize the relay 158 to hold the purge valve 112 closed on power failure. When the energy stored in the capacitors 170 is depleted, the driver 198 is disabled and the valve 112 automatically opens. Thus, with this technique, the cryopump can be purged and the consequences of the unsafe condition may be mitigated even if there is a failure in the timing circuit 168. By example, the time delay circuit 168 may allow for opening the purge valve after two minutes, and power from the electrochemical capacitors 170 may be insufficient to hold the purge valve open after three minutes.

Additional fail-safe techniques can be implemented that are consistent with this technique. For example, the timer 168 can also include a circuit that quickly drains the power from the capacitors 170. Such a circuit can help ensure that the capacitors 170 cannot energize the purge valve 112 for more than a safe time period of time, such as three minutes.

A status light indicator 174 is also included in the autopurge control module 150. The status light indicator 174 may be a status light-emitting diode, which indicates the power and recharge status of the electrochemical capacitors 170.

Controlled Charging of the Capacitors

The charging circuit 172 is used to charge electrochemical capacitors 170 when power is available. In certain circumstances, it may be useful to deliberately impede the charging circuit 172 from quickly charging the capacitors 170, even though the capacitors 170 is capable of being fully charged in a matter of seconds. For example, if the capacitors 170 were allowed to charge normally and there were rapid and intermittent cycles of power failures and recoveries, there is a possibility that the purge valve would never be allowed to open even though the cryopump was warming to an unsafe condition. Specifically, every time power was recovered, the capacitors 170 would be allowed to fully charge. To avoid this situation, the charging circuit 172 can charge the capacitors 170 very slowly by applying a series of controlled current pulses to the capacitors 170.

Power Failure Recovery

Prior power recovery schemes could be turned off by a user or by a host system and they often required an extensive amount of resources and downtime for the pump. When power is restored in the vacuum system, a user could opt to abort the power failure recovery routine. If ignition sources are present, however, turning off the power failure recovery could lead to a potentially dangerous situation in the pump vessel and exhaust systems.

The recovery typically includes three different possible system responses to restored power. Such a prior power failure recovery system is described in U.S. Pat. No. 6,510,697. This prior system includes a power failure recovery routine which is optional and can thus be turned off at any time. A first possible response of the three, is no response. Because the power failure recovery routine is optional, the user could turn off power failure recovery altogether, and the system would simply not respond to the restored power. If the power failure recovery mode is on and the temperature of the pump is below a certain threshold, a second response includes initiating a cool down of the pump. This typically occurs if the pump is below a programmed threshold, such as 35K. In cool down, the refrigerator is turned on and the pump is automatically cooled. If the pump does not cool to below 20K within thirty minutes, an alarm or flag is set. A third possible response typically involves entering into an entire regeneration cycle if the pump is too warm, for example, if the temperature raises above 35K.

Such a regeneration cycle includes several phases, such as purging, heating, and rough pumping. Usually, several tests are also preformed, such as a purge, pressure and emptiness tests. These tests help determine whether the system must repeat a previous phase of the regeneration cycle. Depending on the amount of gases condensed or adsorbed on the cryopanels, the system typically can repeat a phase or even the entire cycle one to six times before the pump is considered safe or regenerated.

Since semiconductor-fabrication processes are typically performed in separate chambers (each of which may include a cryopump of a cryogenic vacuum system), the downtime during which one or more of these pumps must undergo one or more regeneration cycles can result in a long, involved and expensive process. In today's dynamic global environment, the critical nature of accuracy and speed for the semiconductor industry can mean the difference between success and failure for a new product or even a company. For many semiconductor manufacturers, where typically most of a product's costs are determined before the manufacturing phase, this downtime results in a loss of product development time which can cost the company dearly.

The power failure recovery routine of the present system can reduce the risk of safety hazards in the shortest possible time while using the least amount of resources. Any unsafe situations can be addressed by initiating a safe purge, thereby preventing the accumulation of corrosive or hazardous gases or liquids that can result after power failure, regeneration or cryopump malfunction. According to an aspect of the invention, the safe purge of the present power failure recovery routine prevents a flammable mixture of gases from developing in the pump 104 and exhaust system 118 using the least amount of resources and putting the pump 104 out of normal operation for the shortest possible time. In order to accomplish this, the purge valves 112, 114 may be pulsed only for a period of time, such as five minutes, to ensure that the pump 104 and exhaust system 118 are safe. In another embodiment, the purge gas is applied directly to the cryopanels of the second stage, and bursts of purge gas to the second stage array and exhaust line can be cycled. After a safe purge is completed, the power failure recovery routine does not necessarily have to be followed by an entire regeneration routine. This option is left to the host system or user to decide. The safe purge puts the pump 104 into a safe operating state and allows the pump to revert back to normal operation to reduce the downtime. As discussed in more detail below, for safety reasons, the safe purge of the present power failure recovery routine cannot be aborted and cannot be turned off. The safe purge can be implemented as an inherent, fail-safe, response by the system 120.

Figure 5:
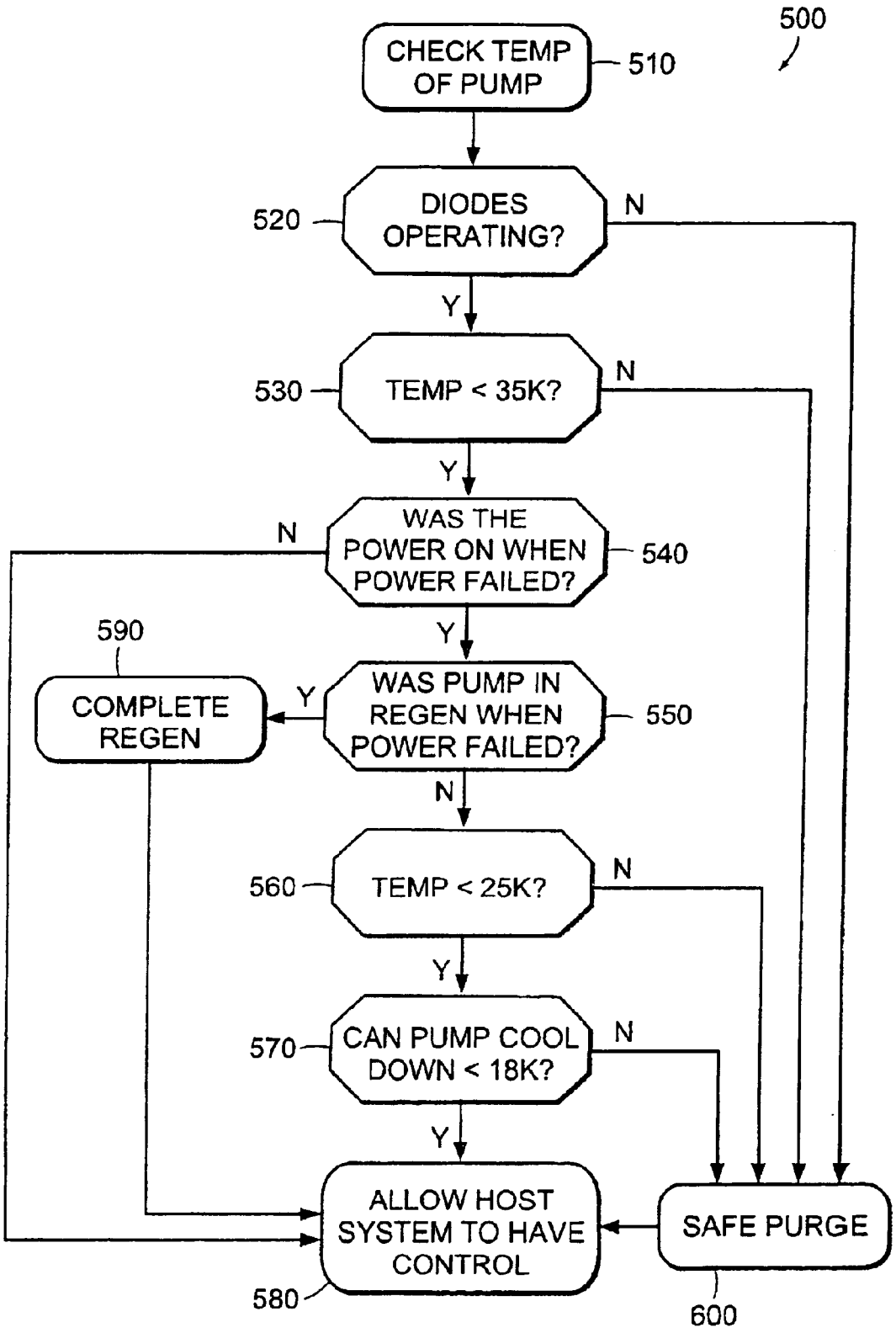
FIG. 5 is a flow diagram describing a power failure recovery routine.

FIG. 5 is a flow diagram describing a power failure recovery routine 500 according to an aspect of the invention. When power is recovered, the cryopump control system 120 determines the temperature of the cryopump 104 at step 510 by detecting a temperature from the temperature sensing diodes of the cryopump 104. If one or more of the temperature diodes are not operating properly at 520, then the system 120 initiates a safe purge at 600.

If the diodes are operating, then at 530 the system 120 determines whether the temperature of the cryopump 104 is less than a predetermined threshold, such as 35K. If the temperature of the pump is not less than this limit, then at step 600 the safe purge is initiated. After the safe purge is completed, at 580 the host system or user is allowed to have control of the cryopump 104.

If the cryopump 104 temperature is less than 35K, then the system 120 determines the operating status of the cryopump 104 at the time of power loss. For example, at step 540, the system 120 determines whether the cryopump 104 was on when the power failed. If the pump 104 was not on when the power failed, then at step 580, the host control system 106 or user is allowed to control the cryopump 104.

If the cryopump 104 was on, then at 550 the process determines whether the pump was in the process of regeneration when the power failed. If the power failure interrupted a regeneration process in the cryopump 104, then at step 590, the system 120 determines whether it can complete the regeneration process where the cryopump 104 left off. At 580, the host system or user is allowed to have control of the cryopump 104.

If the cryopump 104 was not in regeneration, than at step 560, the system 120 checks to determine if the temperature of the cryopump 104 is less than 25K. If the temperature is greater than 25K, a safe purge is initiated at 600. After the safe purge is completed, at 580 the host system or user is allowed to have control of the cryopump 104.

If the temperature of the cryopump 104 is less than 25K and the pump 104 can cool down to a temperature less than 18K at 570, then the pump 104 is cold enough to turn on. At 580, the host system or user is allowed to have control of the cryopump 104.

If the pump 104 cannot cool down to a temperature less than 18K, then it is not cold enough to turn on. At 580, the host system or user is allowed to have control of the cryopump 104 at step 440. The system 104 may set a flag, which indicates that the pump needs to be checked out and this message can be routed to the host controller 106.

Unsafe Conditions

According to an aspect of the invention, an unsafe condition is anything that could present a potential danger to the cryopump 104. For example, an unsafe condition is identified when there is a power failure in the cryogenic vacuum system 100, a temperature of the cryopump exceeds a threshold temperature level, or a faulty temperature diode in the cryopump. In general, when an unsafe condition is determined by the system 120, the gate valve 116 is closed and the cryopump 104 and exhaust line 118 are purged for a period of time, such as five minutes. During this time, the purge valves 112, 114 can be cyclically opened and closed. Also, the valves 112, 114, 114 cannot be controlled by the host controller 106. After the safe purge is completed and the unsafe condition is corrected, the host controller 106 may control the cryopump 104.

Exceeding a Threshold Temperature

Figure 6:
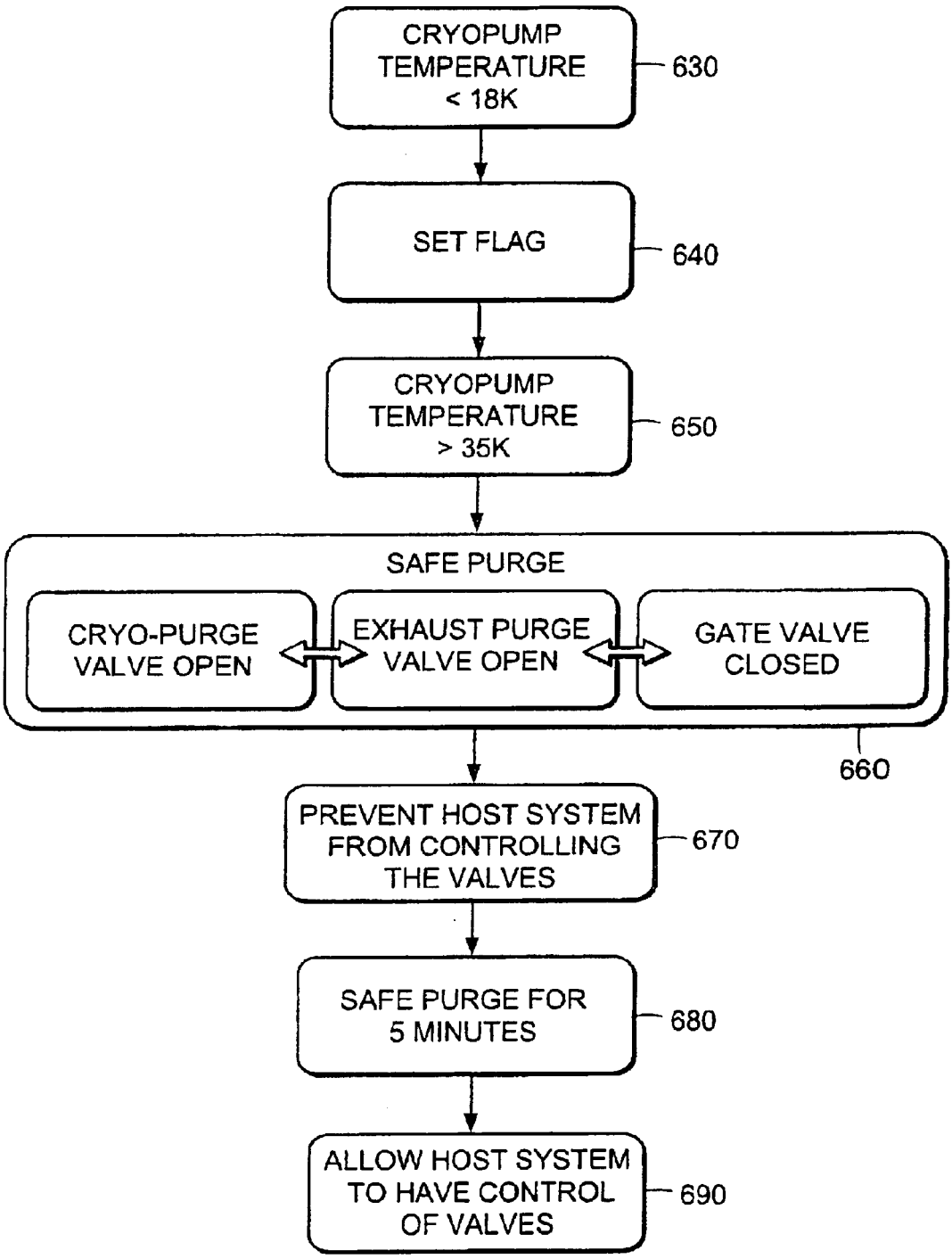
FIG. 6 is a flow diagram describing a process for determining that a temperature of a cryopump exceeds a threshold temperature.

FIG. 6 is a flow diagram describing a process for determining that a temperature of a cryopump exceeds a threshold temperature. According to this aspect of the invention, the system 120 determines at step 630 that the cryopump temperature is below an operational set point, such as 18K. At step 640, the system 120 sets a flag, which indicates that the cryopump has gone below the operational set point. At step 640, the system 120 determines that the temperature of the cryopump has risen to a warmup set point, such as 35K. If the cryopump 104 warms up to a value greater than this parameter, the purge valves 112, 114 are allowed to open 680, and the gate valve 114 is closed, as described at step 660. During this time, at step 670 the host controller 106 is unable to control the valves 112, 114, 116. This safe purge continues for a certain time period, such as five minutes, at step 680. After the five minutes has elapsed, at step 690, the host controller 106 regains control of the valves 112, 114, 116.

Faulty Temperature Diode

As shown in FIG. 3, the cryopump 104 includes one or more temperature sensing diodes 146*a*, 146*b*. If one of the temperature sensing diodes 146*a*, 146*b* is malfunctioning, there is a potential that the cryopump 104 is operating at an unsafe temperature that is not detectable and, thus, an accident may occur. The present system uses local electronics 120 to determine if the diode is functioning properly.

Prior solutions focus on whether the host system has received communication about a temperature of the cryopump. When the host controller is unable to determine a temperature of the pump, the host controller typically initiates a complete regeneration cycle. Initiating a complete regeneration of the cryopump based on this approach, however, can lead to unnecessary waste of valuable time and resources because the inability to receive a temperature reading can be the result of a number of other failures, such as a communication error or equipment failure that are unrelated to a faulty diode. In general, the host system does not have a technique for detecting the operating status of the temperature sensing diode. Instead, the host controller simply initiates a complete regeneration of the cryopump in response to a failure to receive communication about the temperature of the cryopump.

According to an embodiment of the invention, an unsafe situation exists when one of the temperature sensing diodes sensing diodes 146*a,* 146*b* is not operating properly. The invention uses local electronics 120 to detect the operating status of the diode, and the local electronics 120 can respond accordingly. In this way, an offline solution may be implemented that specifically can determine a faulty temperature sensing diode. The ability to determine when a temperature sensing diode is not operating properly may result in increased reliability and the avoidance of unnecessary regenerations, wasted time and expense of resources.

It will be apparent to those of ordinary skill in the art that methods involved in Integration of Automated Cryopump Safety Purge may be embodied in a computer program product that includes a computer usable medium. For example, such a computer usable medium can include any device having computer readable program code segments stored thereon. The computer readable medium can also include a communications or transmission medium, such as a bus or a communications link, either optical, wired, or wireless, having program code segments carried thereon as digital or analog data signals.

It will further be apparent to those of ordinary skill in the art that, as used herein, "cryopump" may be broadly construed to mean any cryogenic capture pump or component thereof directly or indirectly connected or connectable in any known or later-developed manner to an ion implant system.

While this invention has been particularly shown and described with references to certain embodiments thereof, it will be understood by those skilled in the art that various changes in form and details may be made therein without departing from the scope of the invention encompassed by the appended claims.

What is claimed is:

1. A method according to claim 1 wherein of controlling a cryopump, the method comprising:

determining an unsafe condition in a cryopump; and in response to the unsafe condition, directing purge gas into the cryopump by opening a purge valve, and preventing any host controller from controlling the purge valve until the unsafe condition changes to a safe condition, where directing purge gas into the cryopump includes cycling between opening and closing the purge valve.

2. A method according to claim 1 wherein opening the purge valve comprises releasing a normally open purge valve.

3. A method according to claim 1 wherein the response to the unsafe condition further includes directing purge gas into an exhaust system coupled to the cryopump by opening an exhaust purge coupled to the exhaust system.

4. A method according to claim 3 further includes preventing any host controller from controlling the exhaust purge valve until the unsafe condition changes to a safe condition.

5. A method according to claim 3 wherein opening the exhaust purge comprises releasing a normally open exhaust purge valve.

6. A method of controlling a cryopump, the method comprising:

determining an unsafe condition in a cryopump; and in response to the unsafe condition, directing purge gas into the cryopump exhaust system by opening an exhaust purge valve, and preventing any host controller from controlling the exhaust purge valve until the unsafe condition changes to a safe condition, where directing purge gas into the exhaust system includes cycling between opening and closing the exhaust purge valve.

7. A method according to claim 1 wherein an unsafe condition exists when there is any one of: a power failure of the cryopump; or a temperature of the cryopump greater than or equal to a predetermined temperature threshold; or an inability to determine a temperature of the cryopump.

8. A method according to claim 7 further comprising responding to the power failure by:

determining an operating state of the cryopump before the power failure; and if the operating state indicates that the cryopump was in a process of regeneration when the power failed, determining whether initiating a regeneration process is appropriate.

9. A method according to claim 1 wherein the unsafe condition changes to a safe condition after purge gas has been directed into the cryopump for a predetermined amount of time.

10. A method according to claim 1 further includes the step of:

responding to an unsafe condition which changes to a safe condition by determining whether regeneration of the cryopump is necessary.

11. A method according to claim 1 further includes the step of:

preventing regeneration of the cryopump while a gate valve of the cryopump is open.

12. A method according to claim 1 wherein the response to the unsafe condition further includes:

delaying directing purge gas into the cryopump and delaying preventing any host controllers from controlling the purge valve until the predetermined amount of time elapses; and if the unsafe condition still exists when the predetermined amount of time elapses, initiating opening the purge valve and preventing any host controller from controlling the purge valve.

13. An electronic controller for controlling a cryopump, the controller being programmed with instructions for:

determining an unsafe condition in the cryopump;

admitting purge gas into the cryopump by directing a purge valve to open, where admitting purge gas includes cyclically opening and closing the purge valve; and preempting any attempts from any other controllers to control the purge valve until the unsafe condition changes to a safe condition.

14. An electronic controller according to claim 13 wherein the purge valve is directed to open by releasing a normally open purge valve.

15. An electronic controller according to claim 13 wherein the instructions for responding to an unsafe condition further include instructions for:

admitting purge gas into an exhaust line which is coupled to the cryopump by directing an exhaust purge valve which is coupled to the exhaust line to open until the unsafe condition changes to a safe condition.

16. An electronic controller according to claim 15 further includes preempting any attempts from any other controllers to control the exhaust purge valve until the unsafe condition changes to a safe condition.

17. An electronic controller according to claim 15 wherein directing the exhaust open includes releasing a normally open purge valve.

18. An electronic controller according to claim 15 further includes cyclically opening and closing the exhaust purge valve.

19. An electronic controller according to claim 13 wherein an unsafe condition includes any of: a power failure of the cryopump; or a temperature of the cryopump greater than or equal to a predetermined temperature threshold; or an inability to determine a temperature of the cryopump.

20. An electronic controller according to claim 19 wherein the instructions for responding to an unsafe condition that is a power failure further include instructions for:

determining an operating state of the cryopump before the power failure; and if the operating state indicates that the cryopump was in a cool down phase of regeneration when the power failed, initiating a regeneration cycle.

21. An electronic controller according to claim 13 wherein the unsafe condition changes to a safe condition after purge gas has been admitted into the cryopump for a predetermined amount of time.

22. An electronic controller according to claim 13 further include instructions for:

responding an unsafe condition that changes to a safe condition by determining whether regeneration of the cryopump is necessary.

23. An electronic controller according to claim 13 further include instructions for:

preventing regeneration of the cryopump while a gate valve of the cryopump is open.

24. An electronic controller according to claim 13 wherein the instructions for responding to an unsafe condition further include instructions for:

for a predetermined amount of time, delaying the instructions for directing purge gas into the cryopump and delaying preempting any attempts from any other controllers to control the purge valve; and if the unsafe condition still exists when the predetermined amount of time elapses, initiating the instructions for directing purge gas into the cryopump and preempting any attempts from any other controllers to control the purge valve.

25. A cryopump comprising:

a cryopump chamber having pumping surfaces;

a purge valve coupled to the cryopump; and an electronic controller which controls the cryopump, the controller being capable of determining whether the cryopump is operating in a safe or unsafe condition, the purge valve being automatically controlled by the controller in response to an unsafe condition, where the controller responds to the unsafe condition by causing the exhaust purge valve to cycle between open and closed states, the controller overriding any other systems.

26. A cryopump according to claim 25 wherein in response to an unsafe condition, the controller causes the purge valve to open by releasing a normally open valve.

27. A cryopump according to claim 26 wherein the controller further responds to the unsafe condition by causing the purge valve to cycle between open and closed states.

28. A cryopump according to claim 26 wherein the controller further responds to the unsafe condition by:

waiting to cause the purge valve to open until after a predetermined period of time has elapsed; and if the predetermined time has elapsed and the unsafe condition remains, causing the purge valve to open.

29. A cryopump according to claim 25 wherein the controller overrides any other systems during an unsafe condition.

30. A cryopump according to claim 25 further includes:

an exhaust line coupled to the cryopump; and an exhaust purge valve coupled to the exhaust line, wherein the controller further responds to an unsafe condition by:

automatically controlling the exhaust purge valve; and causing the exhaust purge valve to open by releasing a normally open valve.

31. A cryopump according to claim 25 wherein an unsafe condition includes any of: a power failure; or a temperature of the pumping surfaces being greater than or equal to a predetermined temperature threshold; or an inability to determine a temperature of the pumping surfaces.

32. A cryopump according to claim 25 wherein the controller further responds to an unsafe condition by:

determining an operating state of the cryopump before the power failure; and if the operating state indicates that the cryopump was in a process of regeneration when the power failed, determining whether initiating a regeneration process is appropriate.

33. A cryopump according to claim 25 wherein the unsafe condition changes to a safe condition after a predetermined amount of time has elapsed.

34. A cryopump according to claim 25 wherein the controller responds to an unsafe condition that changes to a safe condition by determining whether regeneration of the cryopump is necessary.

35. A cryopump according to claim 25 wherein the controller is programmed to prevent regeneration of the cryopump while a gate valve of the cryopump is open.

36. A system for controlling a cryopump, the system comprising:

a means for determining an unsafe condition in a cryopump;

a means for responding to the unsafe condition by directing purge gas into the cryopump by opening a purge valve, and preventing any host controller from controlling the purge valve until the unsafe condition changes to a safe condition, where directing purge gas into the cryopump includes cycling between opening and closing the purge valve.

37. A method of controlling a cryopump, the method comprising:

determining if a temperature sensor is functioning properly; and responding to a temperature sensor which is not functioning properly by directing a purge valve to open.

38. A method according to claim 37 wherein the purge valve is either a cryo-purge valve coupled to a cryopump or an exhaust purge valve coupled to an exhaust line of a cryopump.

39. A method according to claim 37 wherein the purge valve is maintained open for a period of time.

40. A method according to claim 39 wherein maintaining the purge valve for a period of time further includes preventing any other system from closing the purge valve.

41. A method according to claim 39 wherein directing the purge valve to open further includes delivering purge gas into a cryopump without initiating an entire regeneration process.

42. A method according to claim 37 directing a purge valve to open further includes cycling between opening and closing the purge valve.

43. A method according to claim 37 directing a purge valve to open further includes releasing a normally open purge valve.

44. An electronic controller which monitors one or more temperature sensors coupled to a cryopump, the controller programmed with instructions for:

determining an operating status of one or more temperature sensors coupled to a cryopump; and if one of the temperature sensors does not appear to be operating, initiating a safe purge.

45. An electronic controller according to claim 44 wherein a safe purge includes maintaining a purge valve open for a limited period of time.

46. An electronic controller according to claim 45 wherein the purge valve comprises at least one of a cryo-purge valve coupled to the cryopump, or an exhaust purge valve coupled to an exhaust line of the cryopump.

47. An electronic controller according to claim 44 wherein the controller ensures that the safe purge cannot be aborted.

48. An electronic controller according to claim 44 wherein the safe purge further comprises delivering purge gas into the cryopump without initiating an entire regeneration process.

49. An electronic controller according to claim 44 wherein the safe purge further includes cycling between opening and closing a purge valve.

50. An electronic controller according to claim 44 wherein the safe purge further includes releasing a normally open purge valve.

51. A cryopump comprising:

a purge valve coupled to the cryopump;

one or more temperature sensors coupled to the cryopump; and an electronic controller coupled to the cryopump, the controller configured to determine whether any of the temperature sensors are malfunctioning, the controller initiates a safe purge when one of the temperature sensors has malfunctioned.

52. A cryopump according to claim 51 wherein the safe purge includes holding a purge valve open for a period of time.

53. A cryopump according to claim 51 wherein the purge valve comprises at least one of a cryo-purge valve coupled to the cryopump, or an exhaust purge valve coupled to an exhaust line of the cryopump.

54. A cryopump according to claim 51 wherein the controller ensures that the safe purge cannot be aborted.

55. A cryopump according to claim 51 wherein the safe purge further comprises delivering purge gas into the cryopump without initiating an entire regeneration process.

56. A cryopump according to claim 51 wherein the safe purge further includes cycling between opening and closing a purge valve.

57. A cryopump according to claim 51 wherein the safe purge further includes releasing a normally open purge valve.

58. A system for controlling a cryopump, the system comprising:

a means for determining whether a temperature sensor coupled to a cryopump is failing; and a means for responding to a temperature sensor which fails by opening a purge valve.

59. A power failure recovery method in a cryopump, the method comprising:

after every power failure, responding to restored power in a cryopump by:

determining whether the cryopump has warmed above a recovery temperature set point;

if a temperature sensor coupled to the cryopump is not operating properly, directing the purge valve to open to emit purge gas into the cryopump; and if the cryopump has warmed above the recovery temperature set point, directing a purge valve to open and assuring that the purge valve remains open for a period of time.

60. A power failure recovery method according to claim 59 purge valve that is directed to open is at least one of a cryo-purge valve coupled to the cryopump or exhaust purge valve coupled to an exhaust line of the cryopump.

61. A power failure recovery method in a cryopump, the method comprising:

after every power failure, responding to restored power in a cryopump by:

determining whether the cryopump has warmed above a recovery temperature set point;

if a temperature sensor coupled to the cryopump is not operating properly, directing the purge valve to open to emit purge gas into the cryopump; and if the cryopump has warmed above the recovery temperature set point, directing a purge valve to open, and assuring that the purge valve remains open for a period of time, where directing the purge valve to open includes cycling between opening and closing the purge valve.

62. A power failure recovery method according to claim 61 further includes:

determining the operating state of the cryopump when power loss occurred; and if the operating state of the cryopump indicates that at the time of power loss the cryopump was in a regeneration, initiating a regeneration of the cryopump.

63. A power failure recovery method according to claim 61 further includes ensuring that the response to restored power cannot be aborted.

64. A power failure recovery method according to claim 61 wherein directing the purge valve to open comprises delivering purge gas into the cryopump without initiating an entire regeneration process.

65. A power failure recovery method according to claim 61 wherein the directing the purge valve to open further includes releasing a normally open purge valve.

66. A power failure recovery method according to claim 61 wherein the recovery temperature set point is 34K.

67. An electronic controller for controlling a cryopump, the controller is programmed with instructions for responding to a restoration of power in a cryopump after every power failure by:

determining whether the cryopump has warmed above a recovery temperature set point; and if the cryopump has warmed above the recovery temperature set point, directing a purge valve in the cryopump to open and assuring that the purge valve remains open for a period of time, where directing the purge valve to open includes cycling between opening and closing the purge valve.

68. An electronic controller according to claim 67 the purge valve that is directed to open is any cryo-purge valve coupled to the cryopump or exhaust purge valve coupled to an exhaust line of the cryopump.

69. An electronic controller for controlling a cryopump, the controller is programmed with instructions for responding to a restoration of power in a cryopump after every power failure by:

determining whether the cryopump has warmed above a recovery temperature set point;

if the cryopump has warmed above the recovery temperature set point, directing a purge valve in the cryopump to open and assuring that the purge valve remains open for a period of time; and directing the purge valve to open to emit purge gas into the cryopump if a temperature sensor coupled to the cryopump is not operating properly.

70. An electronic controller according to claim 67 wherein the instructions for responding to a restoration of power further include instructions for:

determining the operating state of the cryopump when power loss occurred; and if the operating state of the cryopump indicates that at the time of power loss the cryopump was in a regeneration, initiating a regeneration of the cryopump.

71. An electronic controller according to claim 67 wherein the instructions for responding to a restoration of power cannot be aborted.

72. An electronic controller according to claim 67 wherein directing the purge valve to open comprises delivering purge gas into the cryopump without initiating an entire regeneration process.

73. An electronic controller according to claim 67 wherein the directing the purge valve to open further includes releasing a normally open purge valve.

74. An electronic controller according to claim 67 wherein the recovery temperature set point is 34K.

75. A cryopump comprising:

a temperature sensor inside the cryopump;

a purge valve coupled to the cryopump; and an electronic control system coupled to the cryopump, after every power failure the control system responds to a restoration of power by:

using the temperature sensor, determining whether the cryopump has warmed above a recovery temperature set point; and if the cryopump has warmed above the recovery temperature set point, directing the purge valve to open and assuring that the purge valve remains open for a period of time, where directing the purge valve to open includes cycling between opening and closing the purge valve.

76. A cryopump according to claim 75 wherein if the controller responds to the power restoration of power by directing the purge valve to open, the controller further responds by directing an exhaust valve coupled to an exhaust line of the cryopump to open.

77. A cryopump according to claim 75 wherein the control system further responds to a restoration of power by:

directing the purge valve to open to emit purge gas into the cryopump if the temperature sensor inside the cryopump is not operating properly.

78. A cryopump according to claim 75 wherein the control system further responds to a restoration of power by:

determining the operating state of the cryopump when power loss occurred; and if the operating state of the cryopump indicates that at the time of power loss the cryopump was in a regeneration process, initiating a regeneration of the cryopump.

79. A cryopump according to claim 75 wherein the response to a restoration of power cannot be aborted.

80. A cryopump according to claim 75 wherein directing the purge valve to open comprises delivering purge gas into the cryopump without initiating an entire regeneration process.

81. A cryopump according to claim 75 wherein the directing the purge valve to open further includes releasing a normally open purge valve.

82. A cryopump according to claim 75 wherein the recovery temperature set point is 34K.

83. A system for recovering from a power failure recovery, the system comprising:

a means for determining whether a temperature is above a recovery temperature set point after every power failure;

a means for directing a purge valve to open when the temperature is above the recovery temperature set point, where directing includes cycling between opening and closing the purge valve; and a means for assuring that the purge valve remains open for a period of time.

* * * * *

UNITED STATES PATENT AND TRADEMARK OFFICE

CERTIFICATE OF CORRECTION

PATENT NO. : 6,920,763 B2
DATED : July 26, 2005
INVENTOR(S) : Paul E. Amundsen et al.

It is certified that error appears in the above-identified patent and that said Letters Patent is hereby corrected as shown below:

Column 11,
Line 47, please delete “according to claim 1 wherein”.

Column 16,
Line 21, after “59” please insert -- the --.

Signed and Sealed this

Eighth Day of November, 2005

JON W. DUDAS
*Director of the United States Patent and Trademark Office*